US010358745B1

(12) United States Patent
Lim et al.

(10) Patent No.: US 10,358,745 B1
(45) Date of Patent: Jul. 23, 2019

(54) METHOD OF CHEMICAL TREATMENT FOR LOOSE FIBERS

(71) Applicant: Tintoria Piana U.S., Inc., Cartersville, GA (US)

(72) Inventors: Sang-Hoon Lim, Cartersville, GA (US); J. Chad Byars, Cartersville, GA (US); Andrea Piana, Cartersville, GA (US)

(73) Assignee: TINTORIA PIANA U.S., INC., Cartersville, GA (US)

( * ) Notice: Subject to any disclaimer, the term of this patent is extended or adjusted under 35 U.S.C. 154(b) by 0 days.

(21) Appl. No.: 15/839,956

(22) Filed: Dec. 13, 2017

Related U.S. Application Data

(63) Continuation-in-part of application No. 15/639,549, filed on Jun. 30, 2017.

(60) Provisional application No. 62/416,406, filed on Nov. 2, 2016, provisional application No. 62/380,725, filed on Aug. 29, 2016.

(51) Int. Cl.

| | |
|---|---|
| ***D06C 3/00*** | (2006.01) |
| ***D01G 21/00*** | (2006.01) |
| ***D06B 15/02*** | (2006.01) |
| ***D01G 13/00*** | (2006.01) |
| ***D06B 23/02*** | (2006.01) |
| ***D01G 7/00*** | (2006.01) |
| ***D06B 1/00*** | (2006.01) |

(52) U.S. Cl.
CPC ..... *D01G 21/00* (2013.01); *D01G 7/00* (2013.01); *D01G 13/00* (2013.01); *D06B 1/00* (2013.01); *D06B 15/02* (2013.01); *D06B 23/026* (2013.01)

(58) Field of Classification Search
CPC ..... B05D 3/12; B05D 1/18; B05D 3/007
See application file for complete search history.

(56) References Cited

U.S. PATENT DOCUMENTS

| | | | | |
|---|---|---|---|---|
| 6,312,810 | B1 * | 11/2001 | Nozaki | C08K 3/32 428/365 |
| 2002/0079074 | A1 * | 6/2002 | Griffith | C08J 9/0004 162/151 |
| 2004/0121114 | A1 * | 6/2004 | Piana | D06M 11/82 428/85 |
| 2008/0118639 | A1 * | 5/2008 | Arvidson | B29C 70/20 427/175 |
| 2008/0237911 | A1 * | 10/2008 | Ardiff | B32B 5/08 264/129 |

(Continued)

*Primary Examiner* — Dah-Wei D. Yuan
*Assistant Examiner* — Kristen A Dagenais-Englehart
(74) *Attorney, Agent, or Firm* — W&C IP

(57) ABSTRACT

A continuous process for the wet chemical treatment of fibers employs one or more squeezing/opening operations post chemical treatment to provide even chemical distribution on the fibers being processed. For squeezing the fiber batt impregnated with chemicals, one or more sets of squeeze rollers which include at least one roller with grooves are used to remove the liquid chemicals from the fiber batt efficiently. The squeezing operation can be coupled with the ability to collect and recycle chemicals for reuse in the chemical treatment process. The continuous process for the chemical treatment of fibers may employ the use of a blending box for the dried chemical-treated fibers in order to compensate for any uneven chemical distribution on fibers occurred during the chemical treatment process.

17 Claims, 3 Drawing Sheets

(56) References Cited

U.S. PATENT DOCUMENTS

2009/0199988 A1* 8/2009 Westerkamp ..... D21F 7/083
162/202

* cited by examiner

METHOD OF CHEMICAL TREATMENT FOR LOOSE FIBERS

CROSS-REFERENCE TO RELATED APPLICATIONS

This application is a continuation-in-part (CIP) application of U.S. Ser. No. 15/639,549 filed Jun. 30, 2017, and claims priority to U.S. Ser. No. 62/380,725 filed Aug. 29, 2016, and to U.S. Ser. No. 62/416,406 filed Nov. 2, 2016, and the complete contents of these prior applications of the inventors is herein incorporated by reference.

FILED OF THE INVENTION

The invention relates to a method of producing chemical-treated fibers using a continuous treatment system. An aspect of the invention is to utilize one or more squeeze rollers with grooves to remove excess amounts of chemicals from the treated fibers. In addition, the invention uses one or more squeezing steps with squeeze roller(s) with grooves, and the squeeze roller(s) with grooves are positioned under the fiber batt. Another aspect of invention is to utilize a fiber blending system that blends dried chemical-treated fibers to compensate for any uneven chemical distribution on the fibers. In some embodiments, chemical formulations are recycled by collecting excess chemicals during the process and sending the collected chemicals back to the treatment bath for re-use.

BACKGROUND

Textile substrates need various chemical treatments depending on the desired properties for the substrates in their end-use applications. Wet chemical treatment for textile substrates can be performed either by batch or continuous process. For a typical batch process, a specific amount of textile substrate is treated with chemical formulations for a specific period of time. The amount of chemicals used is normally based on the amount of the substrate being treated. For continuous textile wet processes, textile substrates are treated continuously by being passed through one or more process steps arranged in tandem. Textile substrates pass through a chemical formulation in a treatment bath, and then the completely soaked substrates pass through a pair of squeeze rollers to remove excess amounts of the chemical formulation in order to control the amount of chemical formulation on the substrates. Then, in many continuous processes, the substrates continue to pass through a drying (e.g., heating) stage, such as an oven, to remove water and to fix the chemicals on the substrates. The amount of chemicals applied on textile substrates depends on the concentration of chemicals in the formulation and the "wet pickup". Wet pickup is the amount of the chemical formulation picked up by the substrate and is expressed as a percentage of the weight of the dry substrate. The wet pickup on the substrate is controlled by the nip pressure of the squeeze rollers. To give uniform chemical distribution throughout or over the substrate, the wet pickup must be controlled evenly across the width and along the length of the substrate.

Many textile processes employ chemical treatments of textile substrates performed at the "fabric stage" (e.g., woven or knitted fabric). However, chemical treatments are also performed at the "fiber stage" (e.g., when chemical-treated fibers are required for yarn spinning or nonwoven production). For a batch process chemical treatment of fibers, a specified amount of loose fibers is loaded in a perforated basket, and the basket is loaded into chemical treatment equipment such as a stock dyeing machine. After loading the basket, a specific amount of chemicals is applied on the fibers using the dyeing machine. In contrast, in a continuous process, the fibers in a web or batt form are continuously passed through one or more process steps arranged in tandem. In operation, the fiber batt (or web) impregnated with a chemical formulation is passed through a pair of squeeze rollers. The amount of the chemical formulation picked up by the fibers is controlled by the pressure of the squeeze rollers. The wet pickup control for the fibers is difficult in a continuous process when compared to woven fabrics because the thickness of the fiber batt (or web) is generally uneven across the width and along the length.

If, in a continuous process, the fibers were subjected to scouring, bleaching, and rinsing, the fibers will likely contain only water after a final squeezing operation. In this case, even though there may be a variation of wet pickup on the fibers, this will generally not pose a problem since there will be no remaining chemical on the fibers after drying. In sharp contrast, when the fibers are subjected to chemical formulation treatment, the wet pickup variation will cause uneven chemical distribution throughout the final dried fibers. This will cause an uneven quality (property) on the final products (yarn or nonwoven) made with these fibers.

U.S. Pat. Nos. 4,213,218 and 4,944,070, each of which are herein incorporated by reference, describe methods of continuous wet finishing for fibers. These patents describe processes which require the loose fibers to be converted into a web or batt form before the wet treatment.

U.S. Pat. No. 4,213,218 describes a continuous chemical treatment of fiber batt. The fiber batt is impregnated with liquid (chemical) by repeated gentle squeezings while passing through the impregnation tank. When the batt leaves the tank, the batt passes through a pair of high-expression nip rolls which remove most of the fluid from the batt to get the target wet pickup. But it is difficult to handle loose fiber batt in the continuous wet process due to the low integrity between fibers in the batt. Especially when the wet fiber batt passes through the nip of a pair of squeeze rollers, there is a high possibility of batt deformation (breakage), which will cause uneven chemical distribution on the fibers as well as disruption of the continuous process.

U.S. Pat. No. 4,944,070 describes wet finishing of cotton fibers at increased speed. To do this, the cotton fibers are converted into an integral batt which has sufficient integrity to withstand the wet processing. This process requires additional equipment to provide integrity on the fiber batt and fully break the integrity after the wet process.

SUMMARY

An objective of the present invention is to provide a method for chemical treatment of loose fibers without sacrificing of process speed and quality.

Another objective of the present invention is to provide a methodology and system which produces a generally uniform (even) chemical treatment on fibers.

The invention generally relates to methods and systems for applying chemicals on loose fibers using a continuous treatment system and to the production of chemical-treated loose fibers on a continuous basis which ensures generally uniform chemical distribution on the treated fibers (e.g. less than 10% or less than 5% or less than a 1% variance for randomnly sampled quantities of fibers subject to the chemical treatment process).

An embodiment of the invention is to utilize squeeze rollers with grooves to control wet pickup on the fiber batt.

Another embodiment is to utilize a plurality (e.g., two, three or more) squeeze rollers at a plurality of stations to control wet pickup on the fiber batt.

Still another embodiment of the invention is to utilize a fiber blending system that blends the dried chemical-treated fibers to compensate for uneven chemical distribution on fibers.

Yet another embodiment of the invention is recycling of recovered chemical formulation collected from the squeezing system to provide advantages such as lowering production costs and providing a more environmentally friendly process, etc.

DETAILED DESCRIPTION

The process of the present invention is intended to produce chemical-treated fibers in the most efficient and economical way as well as to produce the fibers with uniform quality in terms of chemical distribution on the fibers.

In an embodiment of the invention involving the chemical treatment of fibers, the fibers employed may be provided in a bale form. The fibers can be natural fibers, man-made fibers, or combinations of such fibers. Natural fibers include, but are not limited to, cotton, ramie, coir, hemp, abaca, sisal, kapok, jute, flax, linen, kenaf, coconut fiber, pineapple fiber, wool, cashmere, and silk. Man-made fibers include, but are not limited to, polyester, nylon, acrylics, acetate, polyolefins, melamin fibers, elastomeric fibers, polybenzimidazole, aramid fibers, polyimide fibers, modacrylics, polyphenylene sulfide fibers, oxidized PAN fiber, carbon fibers, novoloid fibers, manufactured cellulosic fibers (e.g., rayon, lyocell, bamboo fiber, Tencel®, and Modal®), and manufactured FR cellulosic fibers (e.g., Visil®, Anti-Fcell®, Daiwabo's FR Corona® fibers, Anti-Frayon®, Sniace's FR rayon, and Lenzing FR®).

Figure 1:
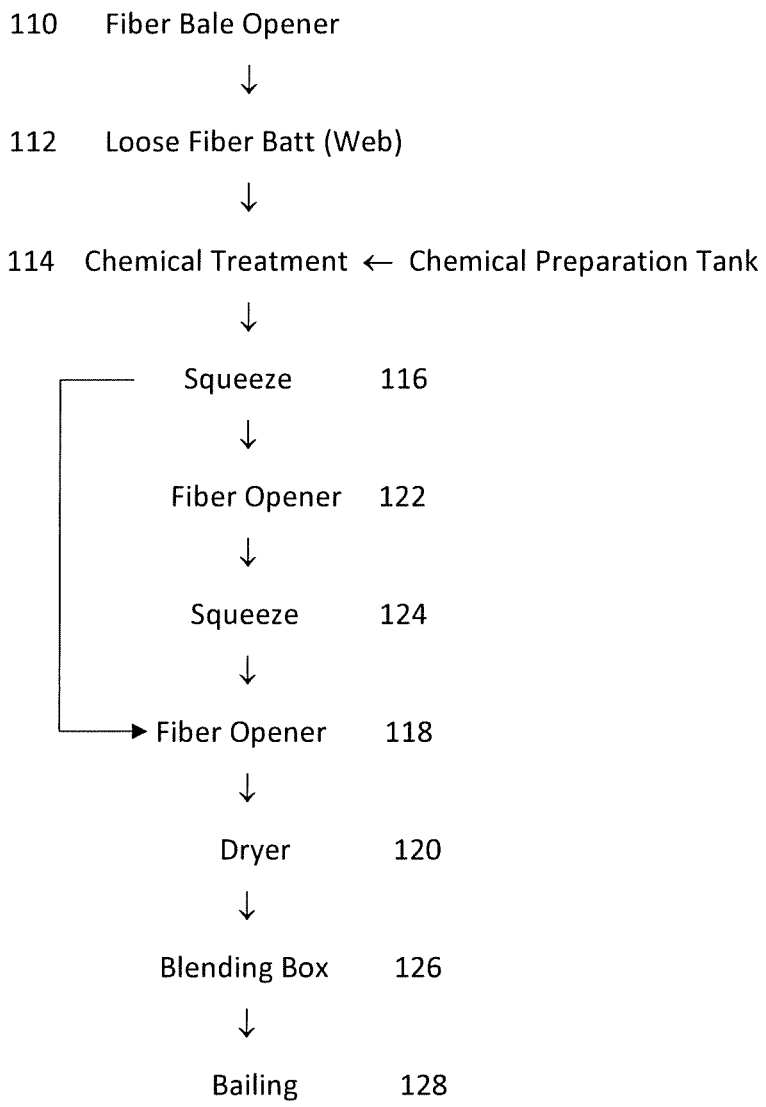
FIG. 1 is a schematic diagram for an exemplary continuous fiber treatment process.

With reference to FIG. 1, an exemplary procedure for a continuous fiber treatment scheme is presented. The order of the processing steps can be varied considerably, additional processing steps can be included, and some of the processing steps can be eliminated from that shown in FIG. 1 within the practice of the invention.

At steps 110 and 112, a loose fiber bale (natural fiber(s), man-made fibers (e.g., synthetic fiber(s), polyester(s), rayon (s), etc.), or combinations of these fibers) is opened and converted to a continuous fiber batt (or web) using a fiber bale opener (a fine opener is preferred). The function of the opener is to break and open the baled fibers and convert them to a continuous form of fibers or fiber batt. At the entrance of the fiber opener, fibers are picked by a spiked apron, blended, opened, and a continuous loose fiber batt (web) is formed on the other side of the opener and released on a conveyer. The fiber openers are commercially available from companies such as Laroche, Rieter, etc. At step 114, the fiber batt on a conveyer is continuously moved into a chemical treatment section (e.g., passing through spray equipment, impregnation by conveying through a chemical bath, etc.) containing the chemical formulation (one or more chemical agents) and the fiber is completely soaked by the chemical(s). The methods to apply chemicals to the fiber include but are not limited to spraying/pouring chemicals on fiber, dipping, or immersing fiber into the bath containing chemicals (e.g., transporting the fiber through the chemical bath). For fiber(s) that need a longer time to be wet, chemical(s) may be sprayed on the fiber before entering a chemical treatment bath, and may also be sprayed, for example, immediately after exit of the chemical treatment bath. Chemicals may be supplied to a spray system, for example, from the chemical bath. In contrast, for fiber(s) that are easily wetted, exposure to the chemical spray system may be sufficient, and impregnation in a chemical bath may not be required. During chemical treatment, if the fiber is impregnated in a chemical bath, the fiber preferably is held stationary to minimize deformation on the fiber batt. One exemplary method to accomplish this (i.e., to make the fiber not to be floated and not to be moved during the wet impregnation process) is to utilize two perforated conveyer systems (e.g., one or more perforated drums, belts, etc.) to hold fibers during chemical treatment. In this case, the fibers are held stationary between two perforated conveyer systems while the fibers are wetted with chemicals. Exemplary chemicals which may be used for the treatment include but are not limited to softeners, hydrophilic agents, hydrophobic agents, water/oil repellents, anti-static agents, soil-release agents, spin finishes, flame retardants, antimicrobials, insect-repellents, UV absorbers, odor absorbers, fragrances, etc. In addition, a plurality of different chemicals (e.g., flame retardants and hydrophobic agents) or different types of chemicals within one category (e.g., two or more antimicrobials) could be used in the treatment.

At step 116, the soaked or otherwise treated fiber batt obtained after exposure to the chemical treatment are passed through the nip of a pair of squeeze rollers to remove excess amounts of chemical and to control the wet pickup on the fiber. In an environmentally friendly embodiment, the squeezed out chemical is collected in or returned to the chemical bath to be re-used in the continuous treatment. For example, the squeeze rollers may be part of the chemical bath and may be located at the end of the chemical treatment section so the squeezed chemical can be directly collected into the chemical treatment bath. In addition to recycled chemicals, a fresh chemical formulation from one or more chemical formulation preparation tanks can be continuously supplied to the chemical treatment bath to replenish the depleted amount of the chemical formulation by fiber treatment and to keep a same level of the chemical formulation in the bath. Multiple sets of squeeze rollers can be used if multiple squeezings are required to reach a target wet pickup on the fiber. In the practice of the invention, the one or more sets of squeeze rollers (e.g., pairs of squeeze rollers, or other groups of squeeze rollers) might be used to assure that the fibers have a targeted amount of chemical on the fibers, e.g., in terms of the wet pickup amount (e.g., 40-100 wt %).

In a preferred embodiment, squeeze rollers with grooves should be used to remove chemicals efficiently from the fiber batt. Preferably, the fiber batt will be squeezed while passing between a pair of squeeze rollers where one of the squeeze rollers has grooves (e.g., either the top or bottom roller is grooved, and in one embodiment the top roller is smooth and the bottom roller is grooved). The grooves can be any shape or dimension, and in preferred embodiments are continuous channels; however, non-continuous channels, channels of varying widths, etc., may also be employed.

In one path shown in the FIG. 1, the squeezed fibers from step 116 are collected and fed into a fiber opener at step 118 to make a fiber batt with redistribution of fibers. A fine fiber opener is preferred to be used as the fiber opener in step 118. In this case, more fibers are opened and blended together. This chemical-treated fiber batt can go directly to a dryer at step 120.

In another path shown in FIG. 1, if final products need a more even (e.g., uniform) chemical distribution, the fiber batt can be passed through another opening/squeezing process at steps 122 and 124. The purpose of these steps is to have chemicals redistributed throughout the fibers. By additional opening and squeezing, higher amounts of liquid chemicals on one portion of fibers can be moved to adjacent fibers containing lower amounts of the chemical. This squeezed fiber batt is opened at step 118 and goes to a dryer at step 120. For a more uniform and even chemical distribution on the fibers, these opening/squeeze steps can be repeated by adding consecutive sets of opening/squeeze sub-systems. In some embodiments, satisfactory final product can be obtained without the squeezing sub-system, e.g., the squeezed fibers out of the chemical treatment followed by one or more opening sub-systems before drying. Multiple opening processes will yield good blending of the treated fibers and will compensate for uneven chemical distribution on the fibers.

The dried fiber is transferred (e.g., blown) from the end of the dryer to a blending box at step 126 through a pneumatic duct system. For fiber blending, a variety of different commercially available blending boxes can be used. Example blending boxes are currently available from companies such as Laroche, Autefa Solutions, etc. As one of example of the blending system, the dried fibers are blown from the rotating spreaders on the ceiling of the blending box, which is a rectangular box that can contain, for example, around 10,000~16,000 lbs of dried fibers. The box is filled from the bottom to the top. When the box is full, one side of box is opened. A movable fiber picking unit is moved toward the open-side of the blending box and the spiked apron on the unit picks up the fibers and the fibers are transferred through a pneumatic duct system to a bale press for bailing at step 128. In the blending box, fibers are spread and filled horizontally and then the fibers are picked up vertically. By doing this, the fibers are well blended. During the process of blending and bailing, fibers are further blended and these processes compensate for any uneven chemical distribution on the fibers.

Figure 2:
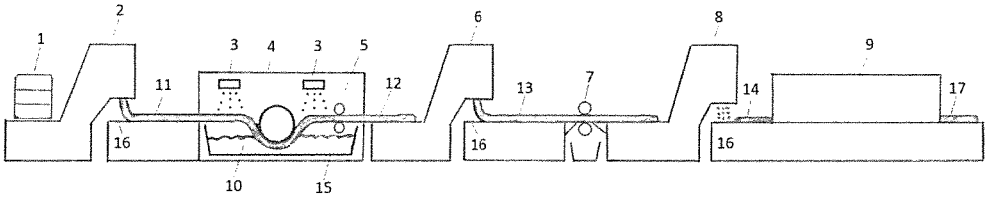
FIG. 2 is a schematic diagram for an exemplary continuous fiber treatment system.

With reference to the drawing figures, an exemplary continuous fiber treatment system is shown in FIG. 2. A fiber bale 1 is opened by a fiber opener 2. Fiber opener 2 opens a fiber bale 1 to form a continuous loose fiber batt 11. The function of the fiber opener 2 is to open fiber bales and convert fibers to a continuous form of fibers or fiber batt. A fine opener is preferred for better opening of the fibers and for uniform fiber batt formation. At the entrance of the fiber opener 2, the fibers are picked up by the spiked apron, blended, opened, and are released on the other side as a continuous fiber batt 11, which is on a conveyer 16 to enter into a chemical treatment section 4. At the chemical treatment section 4, chemical(s) of interest (e.g., fire retardant, etc.) is sprayed or dripped from station 3 onto the fiber batt 11. One or a plurality of spraying or dripping stations 3 may be used. For the fibers that are easily wetted, the spraying step may not be needed. The fiber batt is continuously moved into the chemical 10 in the chemical treatment bath 15. The chemical-treated fiber batt is then squeezed by passage through the nip of a pair of squeeze rollers 5. The pressure on the squeeze rollers 5 controls the amount of chemical pick up by the batt 11, and, as shown in FIG. 2, in some embodiments of the invention, the chemical removed during squeezing step drops directly to the chemical treatment bath 15 for re-use. Multiple sets of squeeze rollers can be used if multiple squeezing steps are required to reach a target wet pickup on the fiber.

Another aspect of the invention may take place after the squeeze rollers 5 in some embodiments. Specifically, the chemical-treated batt 12 is passed through a fiber opener 6 (a fine opener is preferred). At the entrance, the fiber batt is picked up by the spiked apron, broken down, blended, opened, and the fibers are released on the other side as a continuous fiber batt 13. Preferably the opener is a fine opener which will break and open the chemical-treated batt and form a new continuous fiber batt with redistribution of the chemical-treated fibers. In one embodiment, the fiber batt 13 passes through a pair of squeeze rollers 7 to redistribute the chemicals throughout the fibers in the fiber batt 13. During this step if any chemical is squeezed out, it can be collected and sent to the chemical treatment bath 15. In some applications, additional fiber openers 6 and squeeze rollers 7 can be used in series (with the steps discussed above being repeated consecutively in the series) before the final fiber opener 8. The squeezed fiber batt will then go through a final fiber opener 8 to open the compressed fiber batt for drying. The fiber opener 8 will pick up the fiber batt by the spiked apron, break it down, blend, open, and the fibers will be released on the other side as loose fibers 14 which are then passed through a dryer 9. A fine opener is preferred for better opening of the fibers.

Another feature of the invention which can be employed in some embodiments of the invention involves blending of dried chemical-treated fibers 17. The dried fibers 17 are sent to a blending box. Preferably, the dried fibers 17 are transferred through a pneumatic duct system to the blending box. When the dried fibers arrive at the blending box, the fibers are blown from top of the blending box and spread into the box. When the blending box is full, one side of blending box is opened and fibers are picked up by the spiked apron, blended, and the fibers is transferred through a pneumatic duct system to a bale press for bailing. During the process of blending and bailing, fibers are further blended and this process compensates for any uneven chemical distribution on the fibers. In this way, the fiber bails produced will have more a uniform average weight percentage of attached chemical on the fibers in the bundle. For example, the bails will generally have a uniform targeted chemical add-on, which is weight percentage of dried chemical on untreated dried fiber of, e.g., 0.1-20 wt % add-on.

In a variation on the above process, the opening/squeezing step 6 & 7 may be eliminated or the number of squeezing sub systems may be reduced depending on requirements for final product quality. In some embodiments, squeezing step 7 is eliminated, e.g., the squeezed fiber batt out of the chemical treatment station is subjected to one or more opening steps before drying.

In a preferred embodiment of the invention, the squeeze rollers should have grooves to release squeezed chemicals efficiently. The grooves can be in the form of continuous channels which encircle the roller, a single continuous channel that spirals around the roller, discontinuous channels, channels of varying sized and shapes, etc. It has been found that conventional squeeze rollers which have a non-grooved, generally smooth surface that are often used in textile wet processes, are not suitable for use in a continuous loose fiber batt treatment. With conventional squeeze rollers, the squeezed chemicals that were not drained under the fiber batt will be accumulated on top of the fiber batt. This accumulated volume of chemical will reduce the integrity of the fiber batt and cause deformation of the batt while it enters through the nip of the squeeze rollers, which will result in an uneven chemical distribution on the fiber as well as disruption of the continuous process.

Figure 3:
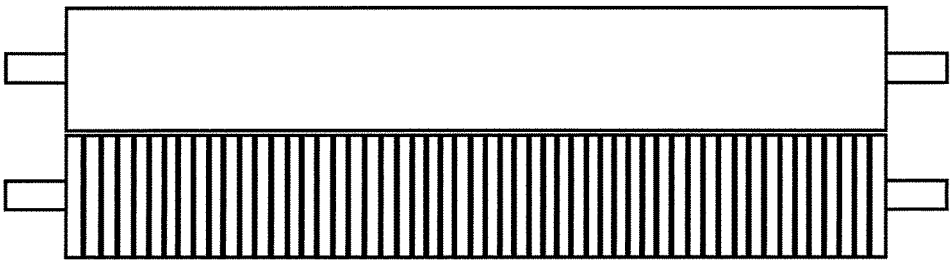
FIG. 3 is a schematic diagram of a set of squeeze rollers.

FIG. 3 shows the example of a preferred pair (set) of squeeze rollers. The top roller is conventional one and the bottom roller is grooved one. A preferred pattern of groove is circumferential grooves as shown in the FIG. 3. The grooves function as channels for the liquid chemical release. The groove dimensions can be designed depending on the type of fiber and density of fiber batt. An example of suitable grooves for use in the process will have: the width of the groove: 5 mm, depth of groove: 5 mm, and interval between grooves: 20 mm. It should be understood that this groove arrangement can be varied considerably, with the grooves independently having widths and depths of 1 mm to 20 mm, and where the spacing can preferably be uniformly spaced from 5 to 50 mm apart, or in some applications be non-uniformly spaced.

While the present invention has been described in terms of preferred embodiments, those skilled in the art will recognize that the invention can be practiced with considerable modification within the spirit and scope of the appended claims.

The invention claimed is:

1. A continuous chemical treatment process for loose fibers, comprising:

opening a fiber bale and forming a web or batt of loose fibers released from the opened fiber bale; then applying one or more chemicals to the loose fibers in the web or batt; then squeezing the web or batt with at least one pair of squeeze rollers to remove a portion of the one or more chemicals from the loose fibers, wherein the at least one pair of squeeze rollers include top and bottom squeeze rollers, wherein the bottom squeeze roller includes one or more grooves on a surface which contacts the web or batt, wherein the removed portion of the one or more chemicals is released from the web or batt below the web or batt to produce a squeezed web or batt with an adhered portion of the one or more chemicals on the loose fibers; then opening the squeezed web or batt with one or more fiber openers; and then drying the loose fibers to produce dried chemically treated loose fibers; then blending the dried chemically treated loose fibers in a blending box to produce a blend of loose fibers with the one or more chemicals on or in the loose fibers, wherein the blend of loose fibers is uniform between randomly sampled quantities of fibers in the blend in terms of an amount of said one or more chemicals on or in the loose fibers; and then baling the blend of loose fibers to produce fiber bales.

2. The continuous chemical treatment process of claim 1 wherein the one or more grooves are continuous grooves which encircle the surface of the roller.

3. The continuous chemical treatment process of claim 1 wherein the one or more grooves are 1-20 mm wide and 1-20 mm deep.

4. The continuous chemical treatment process of claim 3 wherein the one or more grooves are 5-50 mm apart from one another.

5. The continuous chemical treatment process of claim 1, wherein the at least one pair of squeeze rollers includes a plurality of pairs of squeeze rollers.

6. The continuous chemical treatment process of claim 5 wherein each of the plurality of pairs of squeeze rollers include sets of opposing rollers wherein in each set of opposing rollers includes one or more grooves in a bottom roller.

7. The continuous chemical treatment process of claim 6 wherein the one or more grooves are continuous grooves which encircle the surface of the roller.

8. The continuous chemical treatment process of claim 6 wherein the one or more grooves are 1-20 mm wide and 1-20 mm deep.

9. The continuous chemical treatment process of claim 6 wherein the one or more grooves are 5-50 mm apart from one another.

10. The continuous chemical treatment process of claim 1 wherein the opening the squeezed batt or web step is performed a plurality of times and the one or more fiber openers includes a plurality of fiber openers.

11. The continuous chemical treatment process of claim 1 further comprising selecting a target weight percentage range of the one or more chemicals to be adhered to the fibers after drying, wherein the steps of applying, squeezing, opening the squeezed batt or web step, and drying are performed to achieve the target weight percentage range for the adhered portion.

12. The continuous chemical treatment process of claim 1 further comprising collecting the one or more chemicals removed from the fibers during the squeezing step, and recycling the one or more chemicals for use in the applying step.

13. The continuous chemical treatment process of claim 1 further comprising the step of selecting a target average chemical weight percentage per bale, and wherein the steps of squeezing, opening the squeezed batt or web, drying, blending, and baling are performed so as to produce bales of fiber with the target average chemical weight percentage per bale.

14. The continuous chemical treatment process of claim 1, wherein the applying, squeezing, opening, drying, blending, and baling steps are performed such that a weight percentage of dried chemical on the loose fibers in the bales produced constitutes 0.1-20 wt % add-on compared to untreated dry loose fibers in bales which are opened.

15. The continuous chemical treatment process of claim 1, wherein the wherein the blend of loose fibers has less than 10% variance between randomly sampled quantities of fibers in the blend.

16. A continuous chemical treatment process for loose fibers, comprising:

applying one or more chemicals to loose fibers in a web or batt; then squeezing the web or batt with at least one pair of squeeze rollers to remove a portion of the one or more chemicals from the loose fibers, wherein the at least one pair of squeeze rollers include top and bottom squeeze rollers, wherein only the bottom squeeze roller includes one or more grooves on a surface which contacts the web or batt, wherein the removed portion of the one or more chemicals is released from the web or batt below the web or batt to produce a squeezed web or batt with an adhered portion of the one or more chemicals on the loose fibers; then opening the squeezed web or batt with one or more fiber openers; and then drying the loose fibers to produce dried chemically treated loose fibers.

17. The continuous chemical treatment process of claim 16, further comprising:

blending the dried chemically treated loose fibers in a blending box to produce a blend of loose fibers with the one or more chemicals on or in the loose fibers, wherein the blend of loose fibers is uniform between randomly sampled quantities of fibers in the blend in terms of an amount of said one or more chemicals on or in the loose fibers; and then baling the blend of loose fibers to produce fiber bales.

* * * * *